US005280799A

United States Patent [19]

Alajajian

[11] Patent Number: 5,280,799

[45] Date of Patent: Jan. 25, 1994

[54] UMBRELLA WITH TWO-WAY FLASHLIGHT

[75] Inventor: Philip M. Alajajian, 336 Wellman Ave., North Chelmsford, Mass. 01863

[73] Assignee: Philip M. Alajajian, North Chelmsford, Mass.

[21] Appl. No.: 2,630

[22] Filed: Jan. 11, 1993

Related U.S. Application Data

[63] Continuation-in-part of Ser. No. 897,002, Jun. 11, 1992, abandoned.

[51] Int. Cl.[5] ..... A45B 3/00

[52] U.S. Cl. ..... 135/16; 135/25.41; 135/910; 362/102

[58] Field of Search ..... 135/65, 910, 66, 16, 135/15.1, 25.4, 25.41; 362/102, 32

[56] References Cited

U.S. PATENT DOCUMENTS

| | | | |
|---|---|---|---|
| 1,051,370 | 1/1913 | Hertz | 135/910 X |
| 1,066,540 | 7/1913 | Smithwick | 135/910 X |
| 1,067,646 | 7/1913 | Downey | 135/910 X |
| 1,079,088 | 11/1913 | Wysocki | 135/910 X |
| 1,128,167 | 2/1915 | Manson | 135/910 X |
| 1,151,114 | 8/1915 | Matthies et al. | 135/910 X |
| 1,166,272 | 12/1915 | Smithing | 135/910 X |
| 1,177,241 | 3/1916 | Gay | 135/910 X |
| 1,427,138 | 8/1922 | Walicki | 135/910 X |
| 1,595,023 | 8/1926 | Probe | 135/910 X |
| 2,372,471 | 3/1945 | Campbell | 135/910 X |
| 3,281,586 | 10/1966 | Gonzalez | 135/910 X |
| 4,062,371 | 12/1977 | Bolen | 135/910 X |
| 4,093,969 | 6/1978 | Maynor, Jr. | 135/910 X |
| 4,479,171 | 10/1984 | Mains | 362/102 |
| 4,788,995 | 12/1988 | Rushing | 135/910 X |
| 4,860,179 | 8/1989 | Mui et al. | 362/102 |
| 4,872,468 | 10/1989 | Cole | 135/910 X |
| 4,962,779 | 10/1990 | Meng | 135/910 X |
| 5,036,442 | 7/1991 | Brown | 362/102 |
| 5,079,679 | 1/1992 | Chin-Fa | 362/102 |

FOREIGN PATENT DOCUMENTS

| | | | |
|---|---|---|---|
| 0680200 | 6/1966 | Belgium | 135/910 |
| 3317600 | 11/1984 | Fed. Rep. of Germany | 135/910 |
| 2040676 | 1/1971 | France | 135/910 |
| 2218630 | 11/1989 | United Kingdom | 135/910 |
| 2224931 | 5/1990 | United Kingdom | 135/910 |

*Primary Examiner*—Carl D. Friedman
*Assistant Examiner*—Lan M. Mai

[57] ABSTRACT

An umbrella that when folded functions as a conventional flashlight, and when opened functions as an umbrella with a two-way flashlight handle. The flashlight handle contains two lamps/reflectors. One is located in the side of the umbrella handle. The other is positioned in the base of the handle. The handle also serves as a battery compartment for a plurality of "AA" size batteries. The lamp/reflector at the base of said handle is intended to produce the illuminating power of a conventional flashlight. The lamp/reflector at the side of said handle is intended to provide illumination for the forward path of the umbrella user when the umbrella is fully extended. The side lamp/reflector is positioned to direct light onto the forward path of the user when the handle is held vertically. Either lamp may be activated at a time via a two-way switch, located on side of said handle, when said umbrella is either folded or fully extended. With the umbrella opened and the handle held vertically, activation of the side lamp provides the user lighting to his forward path while activation of the lower lamp illuminates the ground near the user's feet. With the umbrella folded and held horizontally, only the base lamp is normally activated for operation consistent with that of a conventional flashlight.

7 Claims, 4 Drawing Sheets

UMBRELLA WITH TWO-WAY FLASHLIGHT

This is a continuation-in-part of Ser. No. 07/897,002, Filed Jun. 11, 1992, now abandoned.

BACKGROUND OF THE INVENTION

1. Field of the Invention

This invention relates to umbrellas, and more specifically to an umbrella design which integrates a conventional style flashlight and an umbrella into a dualpurpose product, with some special benefits afforded by the synergism. The benefits are primarily the enhanced safety for the umbrella user provided by the attached two-way flashlight system, and the usefulness of having a conventional flashlight and an umbrella contained within a single entity.

2. Background and Description of Prior Art

In the prior art, illuminating umbrellas have been designed primarily to enhance the safety of the umbrella user when walking at night. These designs have incorporated either illuminating handles with small manuverable flashlights attached to or concealed within the handle base, such as U.S. Pat. Nos. 4,860,179 of Mui, 4,881,154 of Tseng, et.al., and 4,788,995 of Rushing, or with lamps attached to the top of the umbrella canopy to improve both visibility and safety such as U.S. Pat. Nos. 4,020,858 of Wilson, 4,031,381 of Carver, and 2,373,471 of Campbell. The prior art has not yet produced an umbrella product that is, in effect, transformable; one that, when folded, functions as a conventional flashlight, and when extended, as an umbrella with a forward directed light. Since umbrellas and flashlights are both considered useful devices to have on hand, they are frequently stored in handbags, briefcases, automobile trunks or glove compartments and the like. By integrating a conventional flashlight and an umbrella into a single product having the full functionality normally associated with each product individually, space efficiency and convenience are two primary synergistic benefits. In addition, the safety and lighting advantages associated with an illuminating umbrella are also realized.

SUMMARY OF THE INVENTION

It is the object of the subject invention concept to provide an illuminating handle for an umbrella which has an optimized structure which when attached to a conventional umbrella system, has the following features. When the umbrella is folded and held horizontally, the combined umbrella/handle system has the utility and feel of a conventional flashlight, a feature not found in any of the designs shown in the prior art. When the umbrella is fully extended, the illuminating handle provides the benefits of forward or downward illumination to light the path of the umbrella user.

The device consists of two basic segments: a two-way flashlight/handle segment and an umbrella segment.

The two-way flashlight/handle segment is comprised of seven components: two lamp systems (each comprised of a flashlight bulb, reflector, and lens), a two-way switch, an integrated battery compartment with cover, an electrical wiring system which employs copper strips, an umbrella release mechanism, and a mechanism for connecting to the umbrella segment.

The lamp systems are located, one at the side, the other at the base of the handle. The lamp system located at the base is integrated with a threaded compartment cover to permit battery installation or bulb replacement. It employs a conventional flashlight lens to focus the light from the paraboliv reflector in the forward direction. The side lamp contains a similar but smaller lens system and is inclined to provide illumination in the downward direction approximately twenty degrees relative to the perpendicular to the umbrella shaft.

The battery compartment is molded within the plastic handle. It contains copper strips which make contact with the batteries, umbrella shaft, and the two-way switch. The umbrella shaft runs through the compartment. The base of said shaft is threaded and thereby used to secure the battery compartment base cover by means of a wing nut. The compartment accommodates two "AA" size, 1.5 volt batteries which are internally wired together in "series" fashion by means of a copper strip on said base cover. This system provides a 3.0 volt battery pack sufficient to power either lamp. The use of "AA" cells helps to minimize the weight of the handle, while still achieving reasonable battery life. The compartment and umbrella shaft are each molded on adjacent sides to fit the curvature of the batteries for a secure mechanical fit.

The individual lamp systems are wired in parallel to the battery pack, intercepted by a two-way switch, so that each receives its required voltage, and the failure of any one lamp will not adversely affect the other. In this design, when the switch is in the center position both lamps are turned off. When in either of the other two positions, the side lamp of the base lamp is activated, but not both lamps concurrently.

The umbrella connecting mechanism consists of a cylindrical molded plastic cavity near the top of the umbrella handle surrounded by molded radial supports and which is sized to accept the lower end of the umbrella shaft. The umbrella shaft is fitted into the cavity and secured with a metal screw which penetrates the handle through the cavity and extends through the hollow metal umbrella shaft.

A mechanical umbrella release switch is constructed of a square plastic insert. It is located in the top section of the umbrella handle. The top section of the plastic umbrella handle contains a square shaped cutout. Fitted into the cutout from inside the handle is the square shaped plastic insert. The insert is flanged at its base so that it cannot be removed through the cutout. Within the handle, it affixes to the metal protrusions of the release mechanism on the umbrella shaft.

The umbrella segment consists of a standard mechanical umbrella design. No improvements are made to the prior art.

DETAILED DESCRIPTION OF THE PREFERRED EMBODIMENTS

Figure 1:
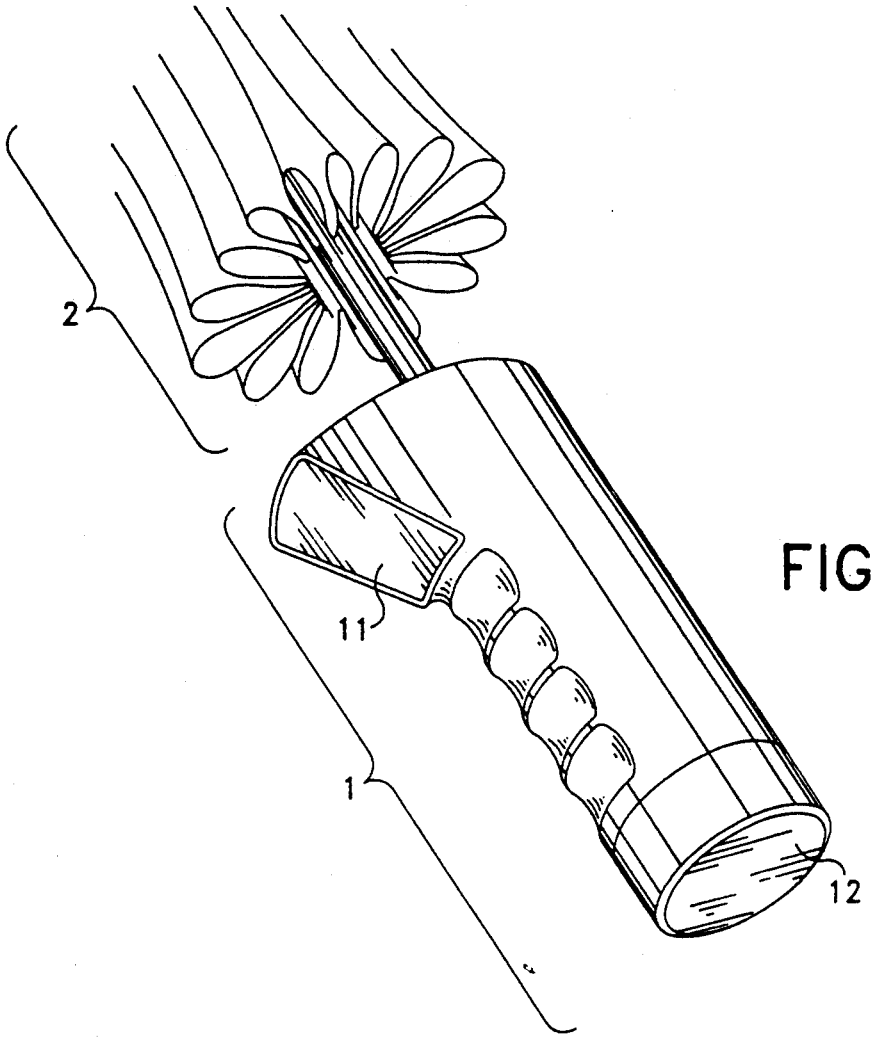
FIG. 1 is a perspective view of a folded umbrella provided with the illuminating two-way flashlight handle of this invention.

Referring to FIG. 1, the umbrella consists of two basic segments; a two-way flashlight handle segment [1], and an umbrella segment [2]. The two-way flashlight handle contains two lamp systems, one located at the side [11], the other at the base of the handle [12].

Flashlight/Umbrella Handle Segment

Figure 4:
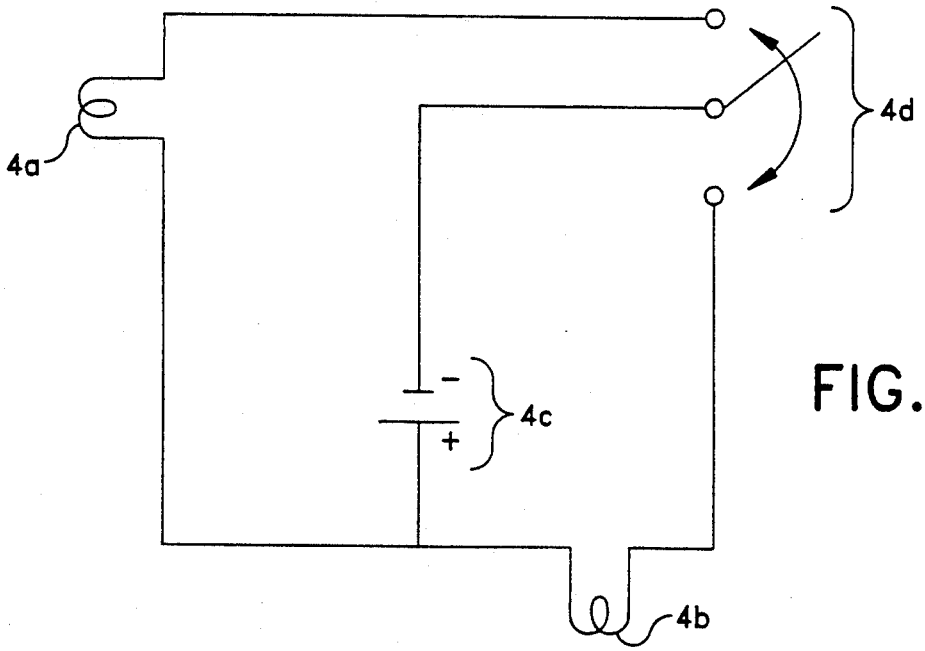
FIG. 4 is a circuit diagram for the electrical system of the illuminating two-way flashlight handle of this invention.
Figure 2:
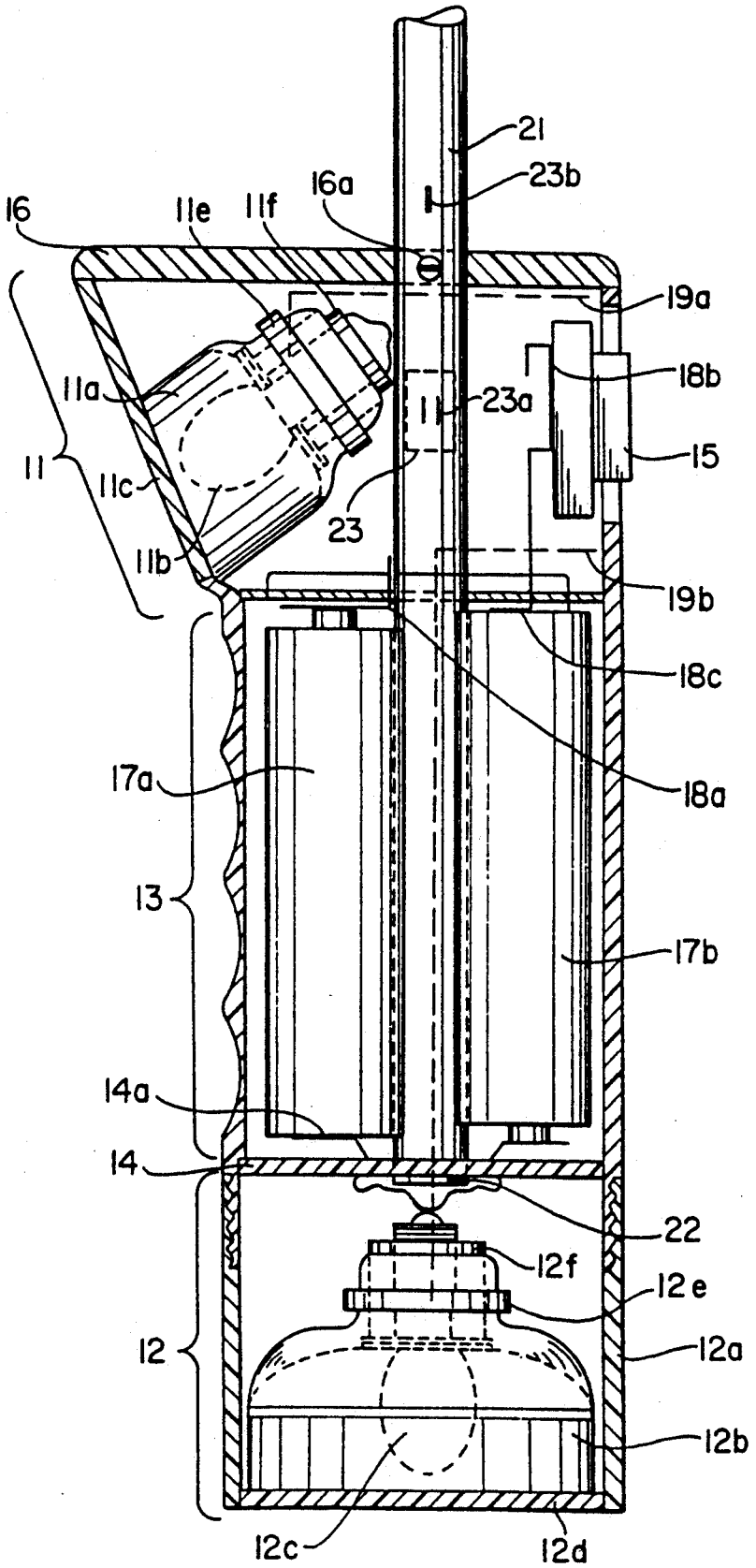
FIG. 2 is a side elevation view of the illuminating two-way flashlight handle of this invention.
Figure 3:
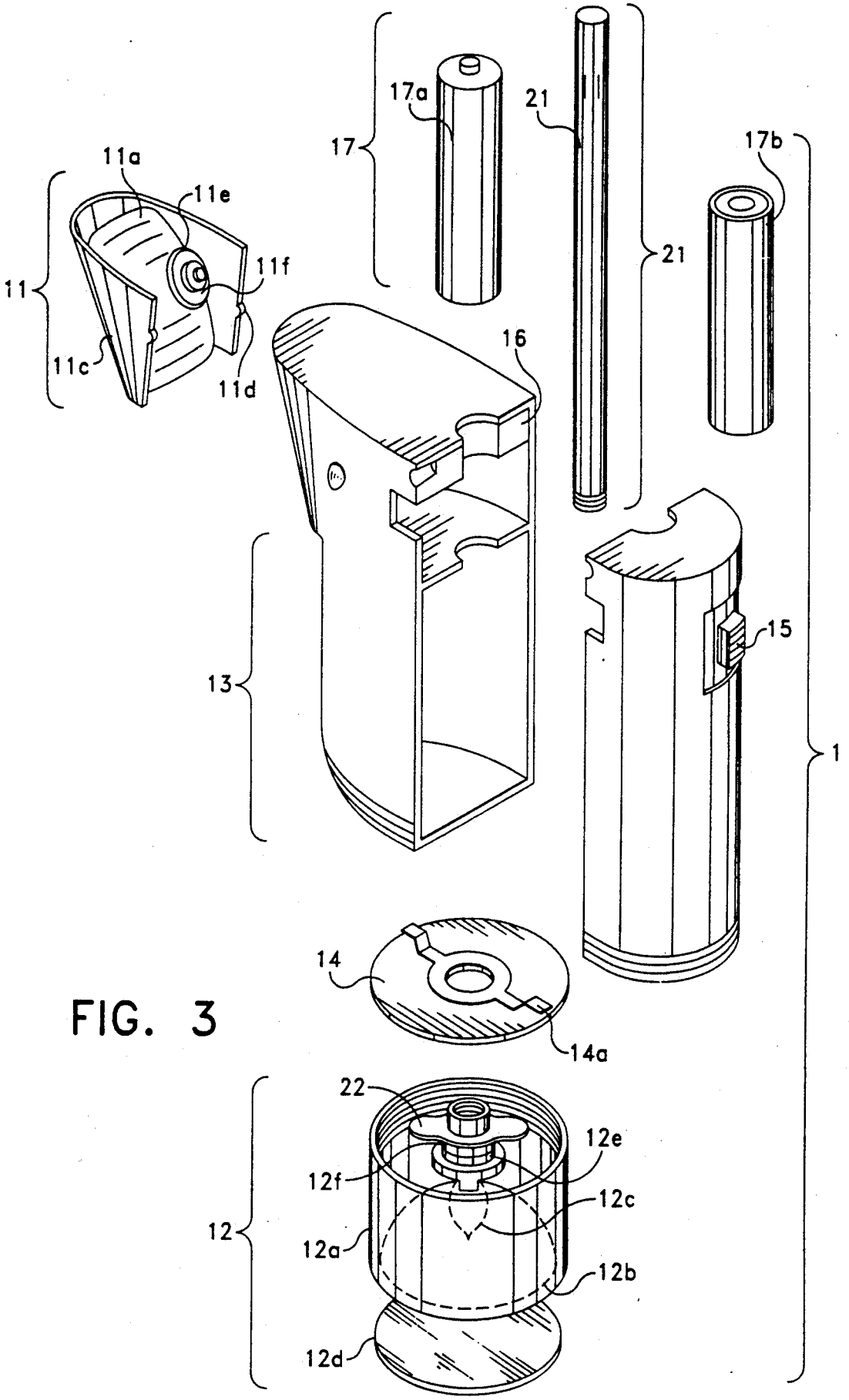
FIG. 3 is an exploded view of the illuminating two-way flashlight handle of this invention.

The flashlight/umbrella handle segment depicted in FIG. 2 consists of seven major components, including two lamp systems, a side lamp system [11] and a base lamp system [12] (each comprised of a flashlight bulb, reflector, and lens), an integrated battery compartment [13] with cover [14], a two-way switch [15], an electrical wiring system [FIG. 4] which employs copper strips [19a, 19b], a mechanism for connecting to the umbrella segment [16], and an umbrella release switch [23]. Each of these components is described in detail in the following sub-sections and as depicted in FIG. 2 and FIG. 3.

Base Lamp/Compartment Cover

The lamp system located at the base [12] is integrated with a threaded plastic handle compartment cover [12a]. The cover allows access for changing the batteries or the base lamp itself. The lamp system contains a metallic plated parabolic reflector [12b], a flashlight bulb [12c], and a flashlight lens [12d] to focus the light from the parabolic reflector in the forward direction. The lamp ground casing is electrically and mechanically attached to a metal ground collar [12e] which fits over the rear of the reflector. The collar is held in place by a plastic plug [12f] which fits into the back of the reflector casing. The collar is used to establish electrical contact with the negatively charged copper strip [19b] affixed to the inside of the handle. The positive side of the bulb makes contact with a metal wing nut [22] affixed to the bottom of the positively charged metal umbrella shaft [21].

Side Lamp

The side lamp [11] is mounted on the side of the handle with an inclination angle of approximately twenty degrees relative to the perpendicular to the umbrella shaft. It contains a metallic plated parabolic reflector [11a], a flashlight bulb [11b], and a flashlight lens. The lens is integrated within a plastic cover [11c]. The cover attaches mechanically to the handle by sliding over a grooved handle cutout and snapping in place by means of two plastic tabs [11d]. The removable cover permits replacement of the side lamp. The side lamp ground casing is electrically and mechanically attached to a metal ground collar [11e] which fits over the rear of the reflector. The collar is held in place by a plastic plug [11f] which fits into the back of the reflector casing. The collar is used to establish electrical contact with a negatively charged copper strip [19a] affixed to the inside of the handle beside it. The positive tip of the bulb makes contact with the positively charged metal umbrella shaft [21]. (A 3 cm long contoured metal sleeve may be placed over the umbrella shaft to aid in establishing electrical contact.)

Battery Compartment

The battery compartment [13] is molded into the plastic handle cavity. The compartment accomodates two "AA" size, 1.5 volt batteries [17a, 17b] which are internally wired together in "series" fashion. This provides the necessary 3.0 volt battery pack required to power either lamp. The use of "AA" cells helps to minimize the weight of the handle, while still achieving reasonable battery life. Referring to FIG. 2, the compartment contains two copper strips which form the positive and negative terminals of the battery pack. The positive terminal strip [18a] also makes contact with the umbrella shaft [21]. The negative terminal strip [18b] also forms the center tap of the two-way switch. The base cover of the compartment [14] contains a copper strip [14a] mounted to its surface which is used to establish a series connection between the batteries. The umbrella shaft [21] runs vertically through the center of the compartment. The base of said shaft is threaded and is used to secure the plastic battery compartment base cover by means of a metal wing nut [22]. The wing nut is also used to establish an electrical connection with the positive tip of the base lamp. The compartment and umbrella shaft are each molded on adjacent sides to fit the curvature of the batteries for a secure mechanical fit.

Two-Way Switch

Referring to FIG. 2, a single two-way (three-position) switch [15] is located near the top of the handle opposite the side lamp. The center tap of the switch is formed from a copper strip [18b] which provides connection to and also forms the negative terminal of the battery compartment located beneath it. This strip carries a negative charge. The lower switch tap [19b] is formed from a copper strip which runs horizontally across one quarter of the internal circumference of the handle and from that point vertically down the handle where it makes contact with the metal ground collar [12e] attached to the lower base lamp. The upper switch tap [19a] is formed from a copper strip which runs horizontally across nearly one half of the internal handle circumference where it makes contact with the metal ground collar [11e] attached to the side lamp.

Wiring

The circuit diagram for the electrical system of the two-way flashlight handle is shown in FIG. 4. The circuit consists of two lamps [4a, 4b] wired in parallel to a power supply [4c] by means of a single pole-double throw switch [4d]. The handle contains all necessary wiring for the lamp systems as shown in FIG. 2. These are wired in "parallel" configuration to the battery compartment primarily by means of the umbrella shaft [21] which is positively conducted and two copper strips [19a, 19b] affixed to the inside of the handle compartment which are negatively conducted. The umbrella shaft connects electrically to the positive contact of each lamp and to the positive terminal of the battery compartment [18a]. The negatively charged strips connect to the metal ground collar of each lamp system [11e, 12e] and to the upper and lower terminals of the switch [19a, 19b], respectively. These copper strips are attached to the casing mechanically by plastic projections within the plastic handle casing (or by being glued onto recessed grooves on the inside of the handle). The center tap of the switch consists of a copper contact which is formed from a copper strip [18b] which provides connection to and also forms the negative terminal of the battery compartment located beneath it. This strip carries a negative charge. The lower switch tap is formed from a copper strip [19b] which runs horizontally across one quarter of the internal circumference of the handle and from that point vertically down the handle where it makes contact with the metal ground collar [12e] attached to the lower base lamp. The upper switch tap [19a] is formed from a copper strip which runs horizontally across nearly one half of the internal handle circumference where it makes contact with the metal ground collar [11e] attached to the side lamp.

Mechanical Interface to Umbrella Segment

Referring to FIG. 2, the umbrella connecting mechanism [16] consists of a cylindrical molded plastic cavity located within the top segment of the handle. It is surrounded by molded radial supports and sized to accept the lower end of the umbrella shaft. The umbrella shaft is fitted into the cavity and secured with a metal screw [16a] which penetrates the handle through the cavity and extends through the hollow metal umbrella shaft. The umbrella shaft [21] extends through this mechanism and the battery compartment [13] beneath it. At the base of the battery compartment, the shaft is mechanically held in place by the plastic compartment cover [14] and secured using a metal wing nut [22]. The wing nut also serves as an electrical contact for the base lamp.

Umbrella Release Switch

Referring to FIG. 2, the handle contains a mechanical umbrella release switch which is constructed of a square plastic insert [23]. It is located in the top section of the umbrella handle. The top section of the plastic umbrella handle contains a square-shaped cutout. Fitted into the cutout from inside the handle is the square-shaped plastic insert. The insert is flanged at its base so that it cannot be removed through the cutout. Within the handle, it affixes to the metal protrusions [23a] of the release mechanism on the umbrella shaft.

Umbrella Segment

The umbrella segment is illustrated in FIG. 1.

Umbrella

The umbrella segment [2] consists of a standard mechanical umbrella design. No improvements are made to the prior art.

Umbrella Release Control Mechanism

As described in FIG. 2, the release control mechanism is a metal tooth [23b] projecting through the umbrella shaft which is used to restrain the spring loaded umbrella from opening. The position of the tooth is controlled (raised or lowered) by movement of a metal bar internal to the shaft attached to the tooth. This bar is accessable by two lower teeth [23a] which also project through the shaft and to which the umbrella release switch [23] is affixed.

Detailed Description of a Modified Species of the Preferred Embodiment for Accomodating Three or More "AA" Batteries The illuminating capability of the Umbrella with Two-Way Flashlight can be enhanced by including additional batteries in the battery compartment to support higher power lamps. The preferred embodiment of the Umbrella with Two-Way Flashlight described above is restrictive in that it can only accommodate two "AA" batteries within a standard sized umbrella handle. Employment of the preferred design to accommodate three or four batteries requires a larger than standard handle size. Further, the internal wiring required to connect the multiplicity of batteries within the battery compartment becomes cumbersome. For this reason a modified species of the embodiment is required to accommodate additional batteries with minimal impact on both the size and the internal wiring complexity of the handle. A modified species is described in the following paragraphs that satisfies these requirements.

Figure 5:
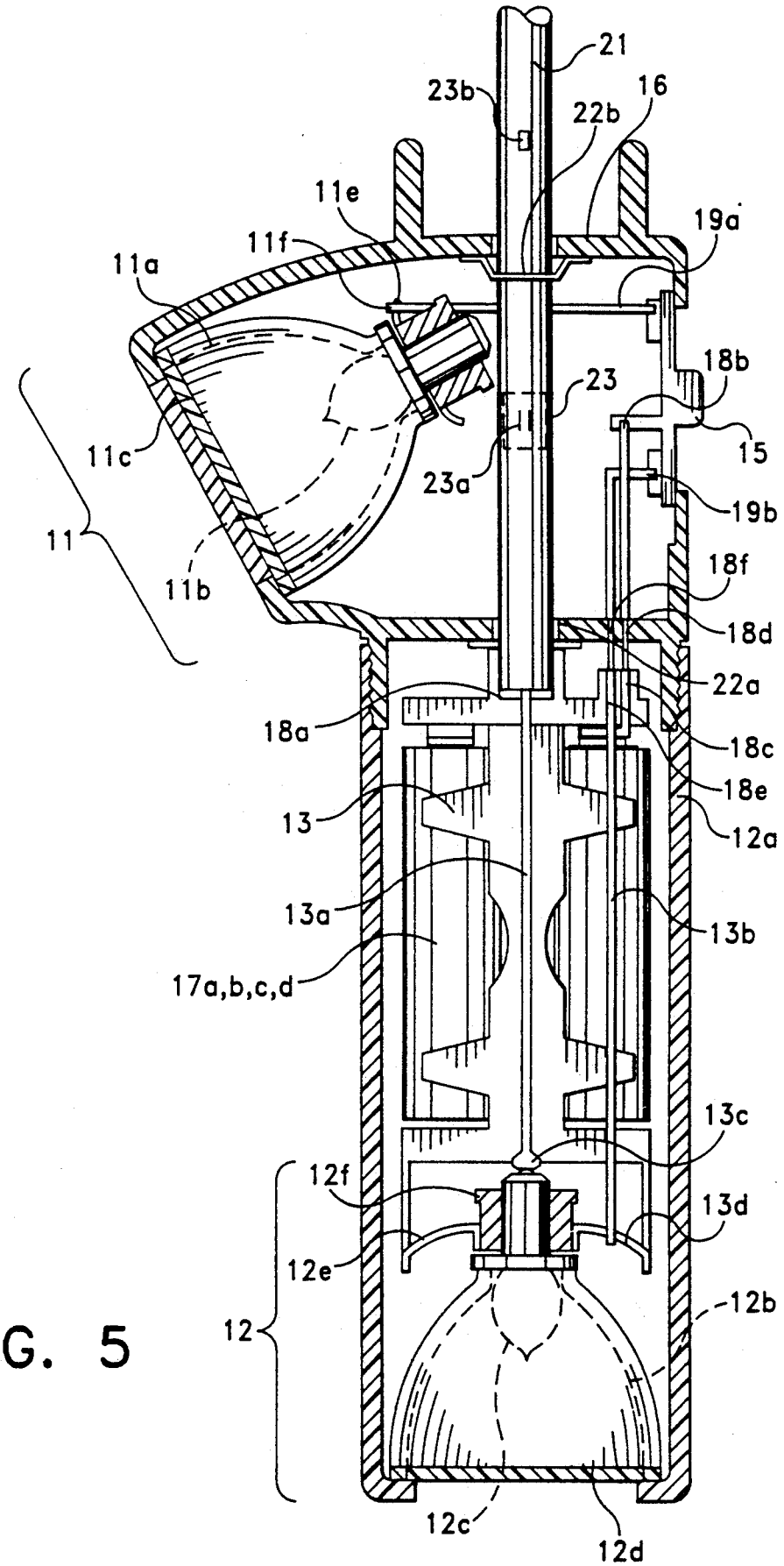
FIG. 5 is a side elevation view of a modified species of the illuminating two-way flashlight handle of this invention.

The modified species, shown in FIG. 5, is based on the preferred embodiment. It has the same overall shape and characteristics. The location and design for the side lamp system [11], base lamp system [12], and two-way switch [15] has not changed. The primary differences result from the removal of the umbrella shaft from within the segment of the handle containing the batteries to allow additional space for the batteries, and the inclusion of a separate and removable battery module [13]. The base of the umbrella shaft terminates in the top segment of the handle at a metal termination joint [22a] just below the side lamp system. The shaft attaches to the handle by means of two metallic clips [22a, 22b] located in the upper segment of the handle.

In the handle, a spool-shaped removable battery module [13] formed from molded plastic accommodates four "AA" sized batteries [17a, 17b, 17c, 17d]. The threaded base lamp compartment cover [12a] is elongated to accommodate both the base lamp system and the battery module. This permits easy installation or removal of each from the handle for the replacement of the bulb or batteries. The battery module is wired internally to provide series connectivity of the batteries to form a 6 volt power source. The positive and negative terminals are located in the upper segment of the battery module. The positive terminal is connected to a metal socket [18a] molded into the center of the top surface. The negative terminal is connected to a metal plug [18c] molded into the top surface between the center socket and the perimeter. The plug establishes electrical contact with the copper strip [18b] comprising the center tap of the two-way switch by plugging into a socket [18d] connecting the strip.

A stiff metal wire [13a] reinforced and insulated in plastic connecting the central metal socket [18a] runs through the central axis of the module to a metal tip [13c] molded into the center of the module bottom. All four batteries are positioned symmetrically about this center wire. The socket accommodates the base end of the metal umbrella shaft that plugs into it. Electrical and mechanical contact is thereby established between the shaft and the socket. The metal tip at the bottom of the battery module is designed to make contact with the positive tip of the base lamp. This wire functionally replaces the need for the umbrella shaft to conduct electricity to the lower lamp as in the preferred embodiment.

A second wire [13b] runs along the length of the battery module to provide connectivity between the metal ground collar of the base lamp system and the switch. It connects to a second metal plug [18e] molded into the top, and to a second metal tip [13d] molded into the module bottom. The plug makes electrical contact with the lower tap of the two-way switch in the compartment top section by plugging into a socket [18f] connecting it. The tip provides electrical and mechanical contact with the ground collar [12e] of the base lamp system by resting up against it. This eliminates the need for a metal strip to be attached to the inside of the handle for this purpose as in the preferred embodiment.

All other aspects of this modified species of design for additional batteries are identical to that of the original preferred embodiment.

I claim:

1. An umbrella comprising an umbrella segment having an umbrella shaft, said shaft having a lower end;

a handle segment having a central axis, a top, a front side, a back side, a lower section and a base, wherein said base includes a threaded compartment cover, said handle segment is further comprised of a switch located on said back side in close proximity to said top; said switch having a copper strip said handle segment further including a first lamp system located at said base and is integral with said threaded compartment cover; said first lamp system functioning as a flashlight;

said handle segment including a second lamp system positioned on said front side of said handle segment near said top; said second lamp system containing a lens system the plane of which is inclined approximately twenty degrees relative to said central axis to provide forward and downward illumination when said handle segment is in the upright position;

Each of said first and second lamp systems including a parabolic reflector, a lens, a bulb, a metal ground collar, and a hollow plastic plug; wherein said bulb comprises a tip and a metal ground casing said reflector having a rear;

said tip constituting a positive contact for each said lamp system;

said metal ground casing connecting electrically and mechanically to said metal ground collar by means of said plastic plug fitted onto the rear of said reflector; said metal ground collar constituting a negative contact for each said lamp system;

said positive contact of each said lamp system engages said umbrella shaft to obtain current;

said negative contact of each said lamp system engages said copper strip to obtain current;

2. An umbrella according to claim 1 further comprising a battery compartment positioned in said handle segment; said battery compartment having a plurality of batteries, wherein each of said batteries includes a positive terminal and a negative terminal;

said batteries are connected together in series fashion to form a composite power source with a positive terminal and a negative terminal; wherein the positive and negative terminals of said composite power source are located at the top of said battery compartment; said positive terminal connecting to said shaft of the umbrella by means of a copper strip; said negative terminal connecting to said switch by means of a copper strip;

said battery compartment further including a cover contacting the tip of said first lamp system, whereby said cover serves to hold said batteries in place and to support said shaft of the umbrella and to establish the series connection of said batteries.

3. An umbrella according to claim 2 further comprising an umbrella connecting mechanism positioned at said top of said handle segment; said connecting mechanism consisting of a cylindrical molded cavity surrounded by radial supports; said lower end of said shaft being received in said molded cavity and secured to said handle segment by a first securing means whereby said shaft extending through said battery compartment and being secured by a second securing means at said shaft lower end provides electrical contact to said tip of first lamp system.

4. An umbrella according to claim 1 wherein said switch includes three positions of operation and being positioned close to said top of handle segment and adjacent to said second lamp system.

5. An umbrella according to claim 4 comprising parallel wiring for connecting said lamp systems to said batteries and said switch.

6. An umbrella according to claim 2 further comprising a battery compartment positioned in the lower section of said handle segment; said battery compartment further containing a spool-shaped removable battery module formed from molded plastic; said module having a top section, a bottom section, a positive terminal, a negative terminal, and a center; each of said top and bottom sections having a center; said module having a metal socket molded into the center of the module top section, and a metal tip molded into a center of the bottom section;

said module accommodating a plurality of batteries; wherein said batterymodule being wired internally in series to form a power source; said positive and negative terminals of said battery module locating beneath the top section of said module; said battery module further having an insulated metal wire through said center to establish a positively charged electrical connection with said first lamp system; said batteries are positioned symmetrically about said metal wire, wherein said metal wire connecting to said metal tip;

said metal socket being wired to the positive terminal of said battery module; said metal socket engaging the base end of said centerpost of the umbrella to establish electrical and mechanical contacts between said centerpost and said socket; said metal tip establishing contact with the positive contact of said first lamp system; the negative terminal of said battery module connecting to a metal plug mounted on said top section of said battery module; said plug establishing electrical contact with said copper strip by plugging into a socket connecting said copper strip;

said switch being a two-way switch comprising a lower tap and a center tap wherein said cooper strip forming a center tap of said switch; a metal conductor extending the entire length of said battery module along on side terminating in a metal plug mounted on said top section which makes electrical contact with said lower tap of said two-way switch at the module top section by plugging into said socket; the tip of said conductor makes both electrical and mechanical contacts with the negative contact of said first lamp system, wherein said first lamp system locating beneath and resting against said battery module.

7. An umbrella according to claim 6 further comprising an umbrella connecting mechanism positioned at said top of said handle segment; said connecting mechanism consisting of a cylindrical molded cavity surrounded by radial supports; said lower end of said shaft being received in said molded cavity and secured to said handle segment by a first securing means whereby said shaft extends through top segment of handle being secured by a second securing means and terminating into a metal socket contained within said battery module; said shaft provides electrical contact to tip of said second lamp system.

* * * * *